United States Patent [19]

Sacksen

[11] Patent Number: 4,913,665

[45] Date of Patent: Apr. 3, 1990

[54] MULTI-POLE PLUG CONNECTOR WITH CODING ELEMENTS

[75] Inventor: Claudia Sacksen, Wiesbaden, Fed. Rep. of Germany

[73] Assignee: C. A. Weidmüller GmbH & Co., Fed. Rep. of Germany

[21] Appl. No.: 270,513

[22] Filed: Nov. 14, 1988

[30] Foreign Application Priority Data

Nov. 17, 1987 [DE] Fed. Rep. of Germany ..... 3738900

[51] Int. Cl.[4] ..... H01R 13/64

[52] U.S. Cl. ..... 439/677; 439/680

[58] Field of Search ..... 439/677, 678, 679, 680, 439/681

[56] References Cited

U.S. PATENT DOCUMENTS 2,904,771 9/1959 Burtt et al. ..... 439/680 X

FOREIGN PATENT DOCUMENTS 838849 4/1970 Canada ..... 439/680

1200910 9/1965 Fed. Rep. of Germany ..... 439/677

1615032 1/1972 Fed. Rep. of Germany .

OTHER PUBLICATIONS

Polarite Bulletin 6120, 12-1961.

*Primary Examiner*—Neil Abrams

*Assistant Examiner*—Khiem Nguyen

*Attorney, Agent, or Firm*—Laubscher, Presta & Laubscher

[57] ABSTRACT

In a multi-pole plug connector assembly including pin and socket housings having contact carrying inserts connected therewith, the fastening screws used to connect the inserts with the respective housings have three different head configurations to serve as coding elements for indicating proper orientation of the housings for plugging connection therebetween. One of the three different head configurations can be combined only with itself while the remaining two head configurations can be combined only with each other. A large number of coding possibilities can be obtained for a plurality of adjacent connector assemblies without increasing the space requirement of the assembly and without decreasing the number of poles or pins being connected.

1 Claim, 2 Drawing Sheets

MULTI-POLE PLUG CONNECTOR WITH CODING ELEMENTS

BACKGROUND OF THE INVENTION

The present invention relates to a multi-pole plug connector assembly including a pin member and a socket member, each including a housing and an insert removably connected with the housing by fastening screws. The pin and socket inserts each contain the electrical connectors such as pin and socket connectors, respectively, which are joined to form electrical connections when the pin and socket members are plugged together. In multi-pole connectors of this type, often referred to as heavy plug connectors, it is frequently necessary to provide a coding system in order to avoid plugging mistakes when a plurality of connectors are arranged in spatial proximity.

In order to avoid alteration of commercially available multi-pole plug connectors, and especially the dimensions thereof, a loss in the number of poles being connected is often accepted for coding in such a way that pin-shaped coding elements are inserted into the pole points of the socket member of the plug connector.

BRIEF DESCRIPTION OF THE PRIOR ART

It is known in the art to provide additional separate coding elements in the housings of the pin and socket members by way of the fastening screws used to connect the inserts with the housing members as shown, for example, in the published German patent application No. 1,615,032. In addition to the fact that in some design versions there is no room for these additional coding elements and thus the housings would have to be made larger, it is disadvantageous that additional assembly parts are required which not only have to be manufactured but which also have to be mounted on the housings. Moreover, if it is desired to keep the manufacturing aspect of different additional coding elements within reasonable limits, the number of possible coding combinations is relatively small.

The present invention was developed in order to overcome the drawbacks of the prior devices by providing a codable multi-pole plug connector which retains its unique narrow, commercially-available spatial dimensions without diminishing the number of poles while still providing a large number of coding combinations.

SUMMARY OF THE INVENTION

Accordingly, it is a primary object of the present invention to provide a multi-pole plug connector assembly including separate pin and socket housings, each having an insert connected therewith by a plurality of fastening screws. The pin and socket inserts contain the electrical contacts which are joined together when the housings of the assembly are joined together. More particularly, the fastening screws include head portions which comprise coding elements for preventing improper plugging connections between the pin and socket housings. The screw head portions preferably have at least three separate configurations, the first being capable of mating only with itself and the second and third configurations mating only with each other. In accordance with the location of the separately configured fastening screw heads, the pin and socket housings are visually and mechanically coded to determine the correct plugging connection between the pin and socket housings to properly interconnect the contacts thereof.

In accordance with a more particular object of the invention, the first screw head configuration includes a cylindrical head having a shorter length and a larger diameter than the second and third configurations, the second screw head configuration includes a cylindrical head having a longer length and a smaller diameter than the first configuration, and the third screw head configuration includes a hollow cylindrical head having a length corresponding with the length of the second head, an outer diameter corresponding with that of the first head, and an inner diameter slightly greater than the diameter of the second head. In this manner, with the pin and socket housings correctly oriented and plugged together, opposed first fastening screw heads will mate in end-to-end relation while opposed second and third fastening screw heads will mate with the third head receiving the second head.

BRIEF DESCRIPTION OF THE FIGURES

Other objects and advantages of the invention will become apparent from a study of the following specification when viewed in the light of the accompanying drawing, in which:

FIGS. 2*a* and 2*b* are schematic representations illustrating correct mating between properly oriented coded screw heads while FIGS. 2*c*–2*f* are schematic representations illustrating incorrect mating between improperly oriented coded screw heads.

DETAILED DESCRIPTION

Figure 1:
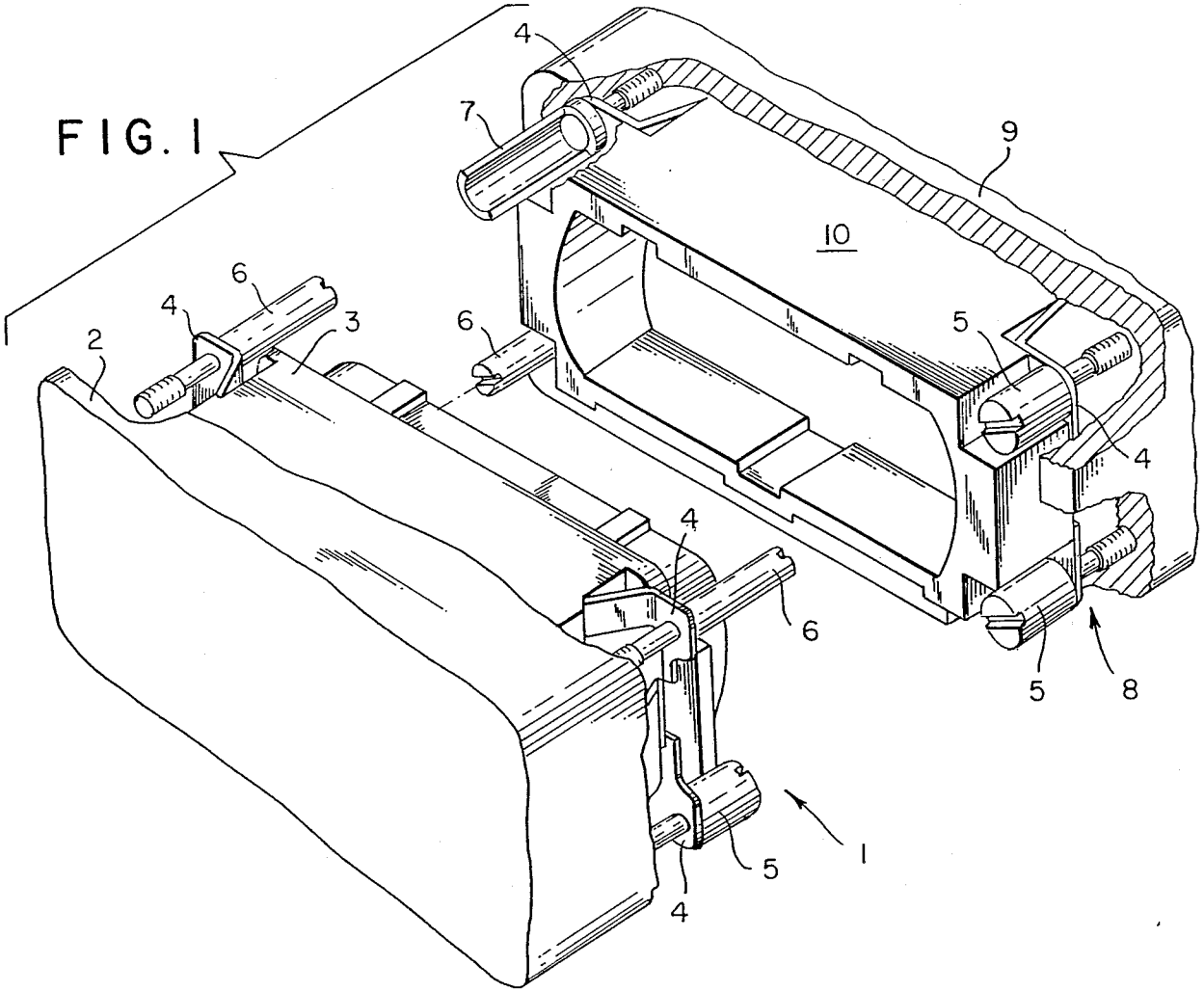
FIG. 1 is an exploded view of the multi-pole plug connector assembly with coded screw heads according to the invention.

In the multi-pole plug connector assembly illustrated in FIG. 1, there is provided a pin member 1 comprising a housing 2 and an insert 3. The housing is preferably made of metal and includes threaded openings in the four corners thereof for receiving fastening screws 5, 6 for connecting the insert 3 with the pin housing 2. The insert includes flanges 4 at opposite sides thereof. The flanges contain openings aligned with the threaded openings of the housing for receiving the fastening screws. The pin member insert 3 contains a plurality of electrical contacts, not shown.

In FIG. 1 is also shown a socket member 8 comprising a housing 9 within which is connected or fastened an insert 10. The socket member insert also includes flanges 4 for receiving fastening screws 5, 6, and 7 which are received by threaded openings in the housing to fasten the insert therewith. As with the pin member 1, the socket member housing 9 is formed of metal and the socket member insert contains a plurality of electrical contacts. As is known in the art, the pin and socket members are adapted for a pluggable connection, thereby to establish an electrical connection between the contacts in the pin and socket member inserts.

As shown in FIG. 1, three screws 5, 6, 7 are provided, each having a different head configuration. Since there are four connection points (at the corners of each housing) between the inserts and their corresponding housing, more than one of the three types of screws may be used to connect an insert with its associated housing. For example, in the socket member 8, two screws 5 of one configuration are provided at the right side of the housing, with one screw each of the second 6 and third 7 configurations being provided at the left side of the housing.

Because in the customary commercial design of such multi-pole plug connectors the fastening screws are located in a mutually flush manner in pin member 1 and in socket member 8 upon the plugging assembly of the socket member and the pin member, the different head designs of screws 5, 6, and 7 are so fashioned that these head designs will provide coding elements that prevent the erroneous plugging of pin members and socket members that do not fit with each other. According to the invention, the differing head designs of the fastening screws 5, 6, and 7 are so fashioned that one particular head design can be put together only with itself while the other two head designs can be put together only with each other.

Figure 2:
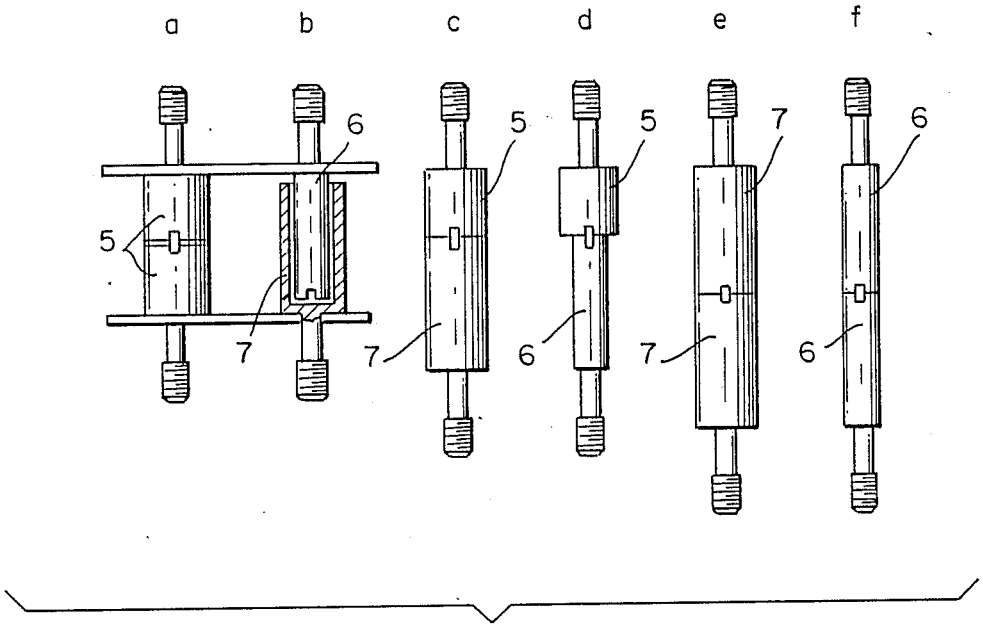

In the example illustrated in FIGS. 1 and 2 of the drawing, the configuration of the head of the first screws 5, which can only be fitted with similarly configured screw heads, has a length less than the length of the heads of the second 6 and third screws and a diameter larger than the diameter of the heads of the second and third screws. The heads of the first screws 5 are so short that the heads of mutually opposite fastening screws 5, after plugging assembly of the pin and socket housings, will still lie in front of each other without any contact as shown in FIG. 2*a*.

The head design of the second screw 6 comprises a cylinder which, in relation to the head of the first screw 5, is definitely longer and thinner, while the head design of the third screw 7 contains a long hollow cylinder whose inside diameter is so big that it can receive the long narrow cylinder of the head of the second screw 6 but not the head of the first screw 5 which is shorter but which also has a larger diameter.

Accordingly, with only three differently designed screw heads, the basic scheme illustrated in FIG. 2 featuring two mutually fitting screw head combinations that can be inserted into each other with four combinations that do not fit in with each other in the sense of the collision is obtained. In FIG. 2*a*, the mutually fitting combination of two first screws 5 with a shorter head that has a bigger diameter is shown. In FIG. 2*b*is shown the mutually fitting combination of the second screw 6 with the thin, long cylinder head and the third screw 7 with the hollow cylinder head receiving the head of second screw 6. FIG. 2*c* shows that the first screw 5 cannot be combined with the third screw 7 because the long hollow cylinder cannot receive the head of the first screw 5 whose diameter is too large. In other words, the socket housing and the pin housing cannot be correctly mated together. FIG. 2*d*shows that the head of the first screw 5 also cannot be combined with the narrow long cylinder head of the second screw 6. FIGS. 2*e* and 2*f* illustrate the fact that second screws 6 likewise cannot be combined with each other and that third screws 7 cannot be combined with each other either, respectively.

Referring once again to FIG. 1, it must be pointed out that the plug and socket members oriented as shown therein will not fit together. The screws 6 and 7 fit with each other at the upper left and the two screws 5 also fit together at the lower right, but the two screws 5 and 6 do not fit at the upper right of the drawing. To make it clear that a large number of coding combinations can be achieved with only three differing head designs, reference is had to the following example wherein each of the pin and socket members utilizes four fastening screws.

If, for example, in a particular application, eight different coding possibilities are required, then for this plug connector assembly, six first screws 5, one second screw 6, and one third screw 7 may be provided. Starting with the basic combinations illustrated in FIG. 2, one can obtain—by virtue of the corresponding particular other corner arrangement of this total of eight screws—in the case of four screw locations per pin member and per socket member, eight times in each case a different coding picture.

If, for one plug connector assembly, four first screws 5, two second screws 6, and two third screws 7 were provided, then this would result in a coding scheme with twenty-four different possibilities of correct fitting. If, for one plug connector assembly, one were to provide two first screws 5, three second screws 6, and three third screws 7, then, according to the same pattern, a coding pattern with thirty-two different fitting possibilities would be obtained. It is worth emphasizing that, overall, in the screw matchups outlined above and in the resultant possibilities, there are no repetitions. In other words, the fitting coding schemes are entirely different from one screw set to the next, with the result that, if necessary, one can extraordinarily increase the number of coding possibilities precisely by making available several such screw sets per plug connector assembly so that, for example, one could obtain a total of eighty coding possibilities from the addition of the coding possibilities of the aforementioned four different screw sets.

Accordingly, by retaining the basic pattern but by increasing the number of fastening screws for the pin and socket members, the number of coding possibilities could be further increased.

Because the existing fastening screws for connecting the inserts with the respective housings in terms of their head design already act as coding elements and to that extent now have a dual function, there is no need for the manufacture and assembly of separate and additional coding elements with a corresponding space requirement. The pin and socket members retain their commercially available dimensions. The coding also does not cause any pole loss. Owing to the design according to the invention, with only three different head designs with respect to the fastening screws, two joinable combinations and four non-joinable combinations of the pin and socket members are obtained. Considering the fact that, customarily, in such multi-pole plug connector assemblies, four fastening screws are needed to connect the inserts with the pin and socket housings, it is obvious that a very large number of different coding possibilities can easily be obtained.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A multi-pole plug connector assembly, comprising (a) separate pin and socket housings adapted to be plugged together;

(b) pin and socket insert members connected within said pin and socket housings, respectively, said insert members each containing a plurality of electrical contacts which are interconnected when said pin and socket housings are plugged together; and (c) a plurality of fastening screws for connecting said insert members with said housings, respectively, said fastening screws including head portions which comprise coding elements for preventing improper plugging connections between said pin and socket housings, said fastening screw head portions comprising three separate configurations, including (1) a first screw head configuration comprising a cylindrical head having a shorter length and a larger diameter than the remaining screw head configurations;

(2) a second screw head configuration comprising a cylindrical head having a longer length and smaller diameter than said first configuration; and (3) a third screw head configuration comprising a cylindrical head having a length corresponding with the length of said second head, an outer diameter corresponding with that of said first head, and an inner diameter slightly greater than the diameter of said second head, whereby when said fastening screws are used to connect said inserts with said pin and socket housings, respectively, said third head is adapted to receive only said second head and the orientation of said different screws will determine the correct plugging of said pin and socket housings to interconnect the sockets thereof.

* * * * *